US006035468A

United States Patent [19]

Lee

[11] Patent Number: 6,035,468

[45] Date of Patent: Mar. 14, 2000

[54] FOLDING BED WITH DETACHABLE LEGS

[76] Inventor: Hsueh Yen Lee, 3F No. 13-1 Ka Chang Rd., Shih Lin, Taipei, Taiwan

[21] Appl. No.: 09/207,960

[22] Filed: Dec. 9, 1998

[51] Int. Cl.[7] ..... A47C 17/74

[52] U.S. Cl. ..... 5/174; 5/310; 5/112; 5/178

[58] Field of Search ..... 5/111, 112, 114, 5/162, 174, 177, 178, 188, 189, 310

[56] References Cited

U.S. PATENT DOCUMENTS

| | | | |
|---|---|---|---|
| 2,404,883 | 7/1946 | Mouw | 5/189 |
| 2,948,905 | 8/1960 | Sevcik | 5/111 |
| 3,089,151 | 5/1963 | Sevcik | 5/111 X |
| 3,108,291 | 10/1963 | Eason | 5/111 |
| 3,295,149 | 1/1967 | Hall | 5/174 |
| 3,602,926 | 9/1971 | Marini | 5/111 |
| 3,602,927 | 9/1971 | Wyss | 5/174 X |
| 4,048,683 | 9/1977 | Chen | 5/180 |

*Primary Examiner*—Michael F. Trettel

*Attorney, Agent, or Firm*—Maria Erlinda C. Sarno

[57] ABSTRACT

A folding bed having a three section mainframe, a swinging left frame, a swinging right frame, these swinging frames hingedly attached on each end of a third stationary section at a mid portion of the mainframe. Foldaway legs are each hingedly connected near a longitudinal edge of the folding mainframe. These above features are in combination with a detachable middle support leg attaching to each third stationary section on the two longitudinal sides of the mainframe. A first structure element is attached to the head lateral side forming the head board, this structure element differing in design from a second structure element attached to the foot lateral side forming the foot board. The mattress support element on the mainframe is made up of independent rows of flexible metal structure running from one longitudinal side of the mainframe to its opposite corresponding longitudinal side. The mattress are inhibited from moving away from the folding mainframe by the foot board and the head board pressing on the mattress and by fasteners securing the mattress to the mainframe and also the head board to the mainframe when the bed is in the folded position.

19 Claims, 5 Drawing Sheets

27
28
30
12
21
11
29
9
26
22
24
6
25

FOLDING BED WITH DETACHABLE LEGS

BACKGROUND

This invention relates to a folding bed with a combined feature of having a detachable middle leg support for ease of transportation, a head and foot board urging on a mattress and a mattress support that lends itself to the movement of the user. The detachable middle support leg, being designed independent from the frame, can be shaped to any desired configuration to lend greater stability or aesthetic look to the bed when in use.

Folding beds have become a necessity especially in homes, hotels and hospitals where additional beds are occasionally needed. Folding beds are designed to endure repeated folding and unfolding, should be easily transportable especially in this age where export and import between countries have become a salient part of commercial trade. Further, the folding beds should be easily set up and dismantled, easily folded and unfolded after assembly and should require as little storage space as possible.

Conventional folding beds usually have two pairs of middle vertically oriented legs which are permanently attached to the bed frame. As such, they require more space for transport and the legs stand the chance of being damaged during transport. These beds also do not have means of inhibiting the movement of the mattress from the mainframe and have mattress supports that provide tension during the folding of the mainframe and/or are uncomfortable to the user. Further, conventional beds do not have a way of indicating the head portion from the foot portion which may be important for some usage and for some individuals.

It is therefore an object of this invention to provide a folding bed with a detachable middle support leg combined with end legs hingedly connected to the bed frame so as to swing out or in as desired.

It is also an object of this invention to provide structure elements of different design attached to the head and foot of the bed frame that apprise the user of the orientation of the bed; serve as handles during the folding and unfolding of the bed; and, prevent movement of the mattress from the mainframe.

It is a further object of this invention to provide a mattress support element that will not provide resistance or stress when the bed is folded for storage.

It is also a further object of this invention to provide fastening straps to the handles and the mattress to provide reinforcement, thereby keeping the mattress from moving while in the folded or unfolded position.

Other objects, features and advantages of the invention will become apparent as the description thereof proceeds when considered in connection with the accompanying illustrative drawings.

SUMMARY OF THE INVENTION

The folding bed of this invention combines several useful features in its design and manufacture. The folding bed comprise a folding mainframe having two longitudinal and two lateral sides, a head and a foot lateral side, foldaway legs hingedly connected near a longitudinal edge of the longitudinal sides of the folding mainframe, a detachable middle support leg, a first structure element attached to the head lateral side, the structure element differing in design from a second structure element attached to the foot lateral side, a mattress, a mattress support element on the mainframe to support the mattress, and fastening means to hold or release the two lateral structures together and further confine the mattress in place. The detachable middle support leg is preferably arcuately triangular in shape to provide greater stability when the bed is moved around while in the folded position. The mattress support element is preferably made of flexible metal structures designed as separate rows of a continuous wave running from one longitudinal side to an opposite corresponding longitudinal side of the mainframe. In this claimed invention, the first and second structure elements attached to the head and foot lateral sides, respectively, serve the function of providing a head and a foot board, a handle for folding and unfolding the bed, and a stopper for inhibiting the movement of the mattress from the folding mainframe.

DETAILED DESCRIPTION

Figure 1:
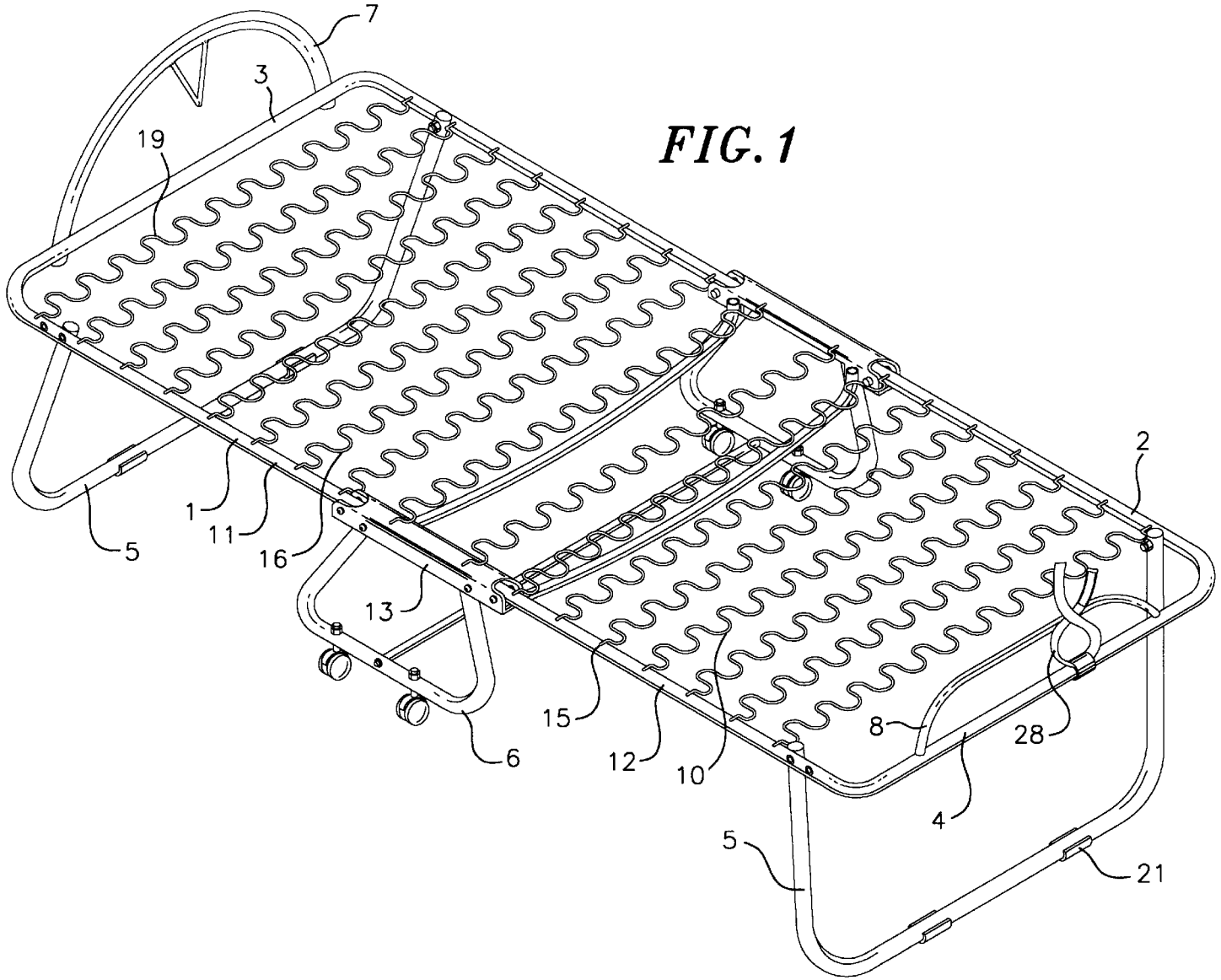
FIG. 1 is a perspective view of the folding bed in its unfolded position.

The folding bed of this invention as shown in FIG. 1, combines several useful features desirable in a folding bed. The folding bed comprise a folding mainframe 1 having two longitudinal 2 and two lateral sides, a head 3 and a foot 4 lateral side, foldaway legs 5 hingedly connected near a longitudinal edge of the longitudinal sides of the folding mainframe, a detachable middle support leg 6, a first structure element 7 attached to the head lateral side, the structure element differing in design from a second structure element 8 attached to the foot lateral side 4, a mattress 9, a mattress support element 10 on the mainframe 1 to support the mattress 9, and fastening means to hold or release the two lateral structures together and confine the mattress in place.

Figure 2:
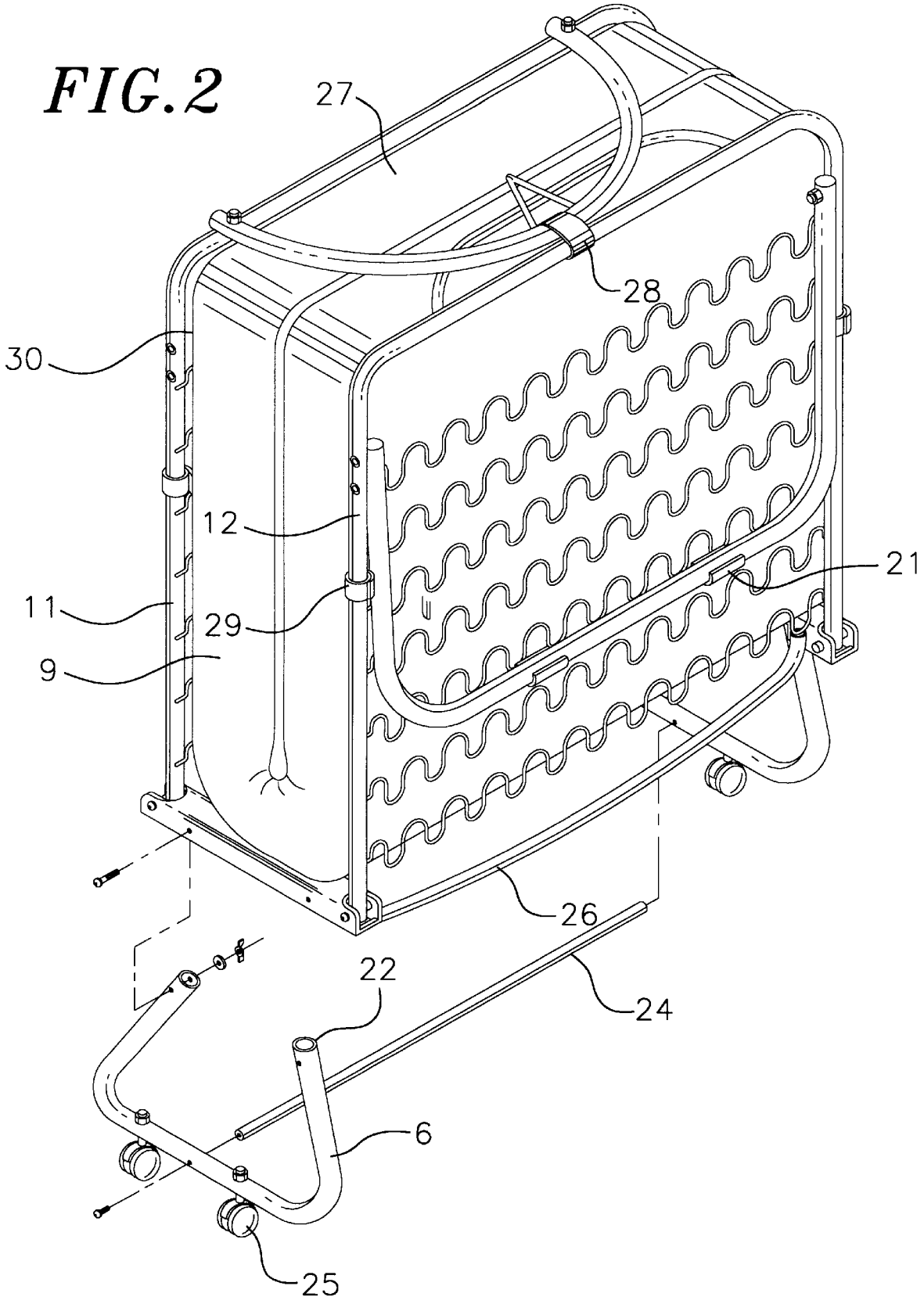
FIG. 2 is a perspective exploded view of the folding bed having a mattress in its folded position showing how the detachable middle support leg is assembled.
Figure 3:
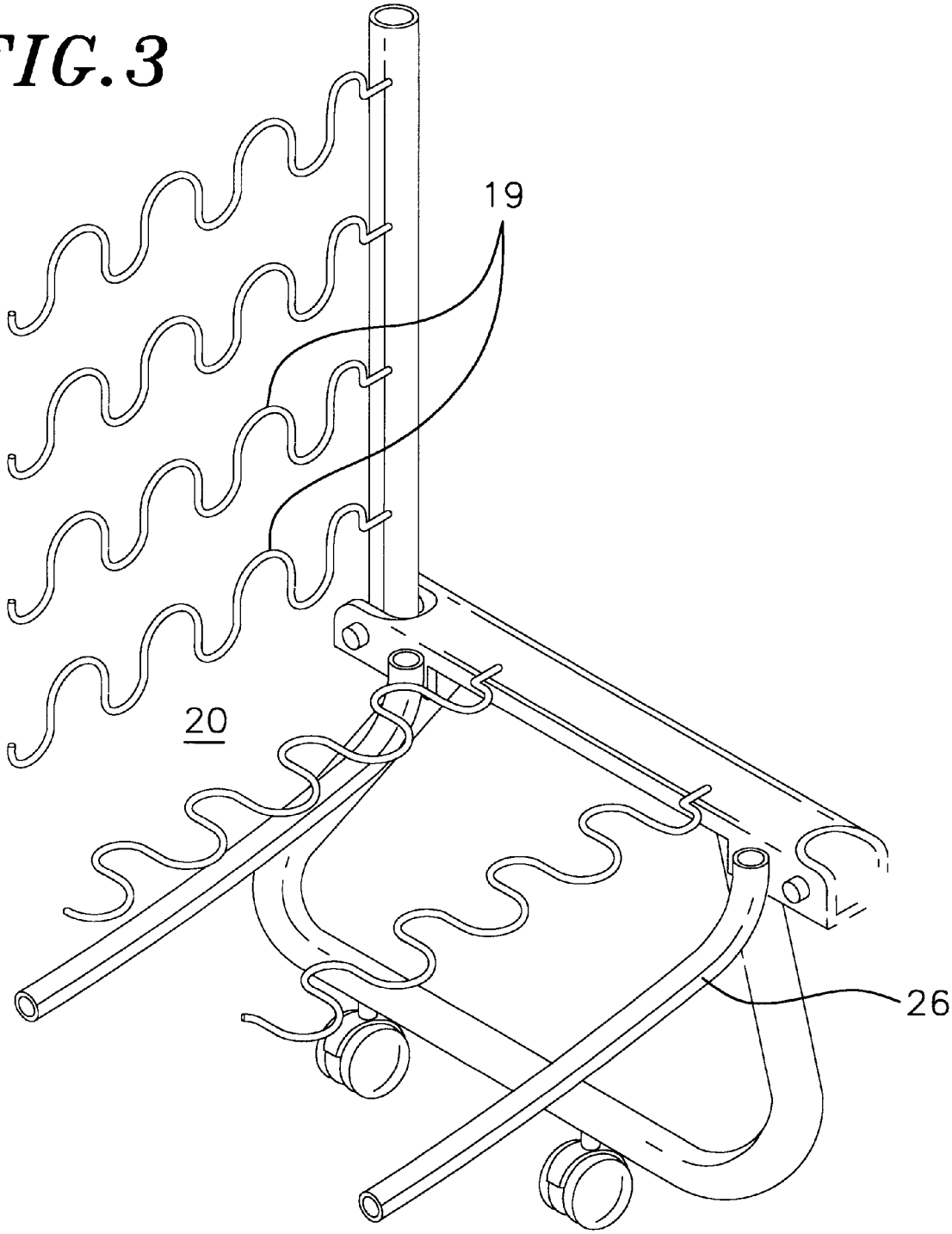
FIG. 3 is a perspective view of a section of the folding bed showing the absence of flexible metal structures at the junction where the folding mainframe bends.
Figure 5:
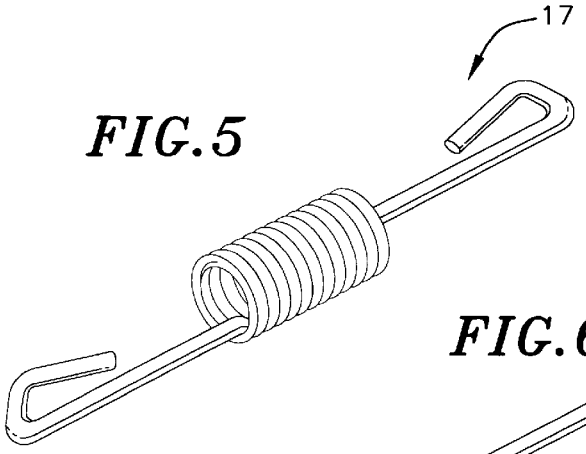
FIG. 5 is a perspective view of a helical coiled spring.
Figure 6:
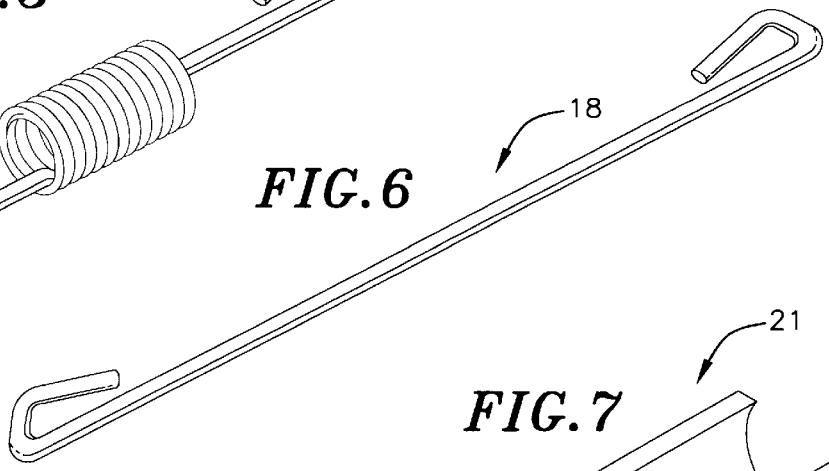
FIG. 6 is a perspective view of a connecting clip.

The folding mainframe 1 of this invention is preferably constructed of metal in a circular tubular form. However, other forms such as square tubular, angled, L-shape, and the like may also be used. Each longitudinal sided of the folding mainframe has three sections, a swinging left frame 11, a swinging right frame 12, these swinging frames hingedly attached or bolted on each end of a third stationary section at the mid portion of the folding mainframe. Using a stationary mainframe connection channel bracket 13 as the third stationary section at the mid portion of the mainframe where the detachable legs attach, is unique to this claimed invention. This mainframe connection channel bracket 13 also serves a the base of the folding bed, positioned parallel to the ground when the bed is folded in an upright position as shown in FIG. 2. Surrounding the top surface 14 of the mainframe, the surface facing the mattress 9, are a plurality of spaced out apertures 15 for receiving a plurality of independent rows of flexible metal structures 16, preferably wavelike, running from one longitudinal side of the mainframe to its opposite corresponding longitudinal side thereby forming the mattress support element 10. This design of separate rows allows independent movement of one row from another row. The two lateral top surface on the lateral sides 3 and 4 of the mainframe may or may not have apertures for receiving optional helical coiled springs 17 shown in FIG. 5 or connecting clips 18 shown in FIG. 6 to connect the flexible metal structure 16 to the lateral sides of the folding mainframe 1. In a wavelike structure, the clips 18 or coiled spring 17 will connect the apex 19 of the waves to the lateral sides of the mainframe, if used. In a typical size folding bed, there are usually eight rows of these flexible metal structure in each swinging frame and two rows on the stationary mid portion 13 of the mainframe for a total of 18 rows. These rows of the flexible metal structure are arranged such that there are no rows in the way at the junction 20 where the mattress support element 10 folds or bends as shown in FIG. 3. These rows of flexible metal structure are preferably designed as a chain of waves for greater flexibility, thereby providing comfort because the mattress support will lend itself better to the movement of the user. Other designs that will function equally well are rows of different geometric shapes such zig zag, circular and the like so long as each row is independent of another. If, however, connection between some rows of the flexible metal structure is desired, connecting clips of a length extending from one row to another row, clipped from an apex 19 of one wave from one row to the apex 19 of a corresponding wave from another row, for example, may be used to transversely connect one row to the other. These connections can be done between the rows running through the swinging frames but not on the rows between the swinging frames and the stationary mid portion of the mainframe to preserve the claimed invention's object of keeping the junction free of any structure.

Figure 4:
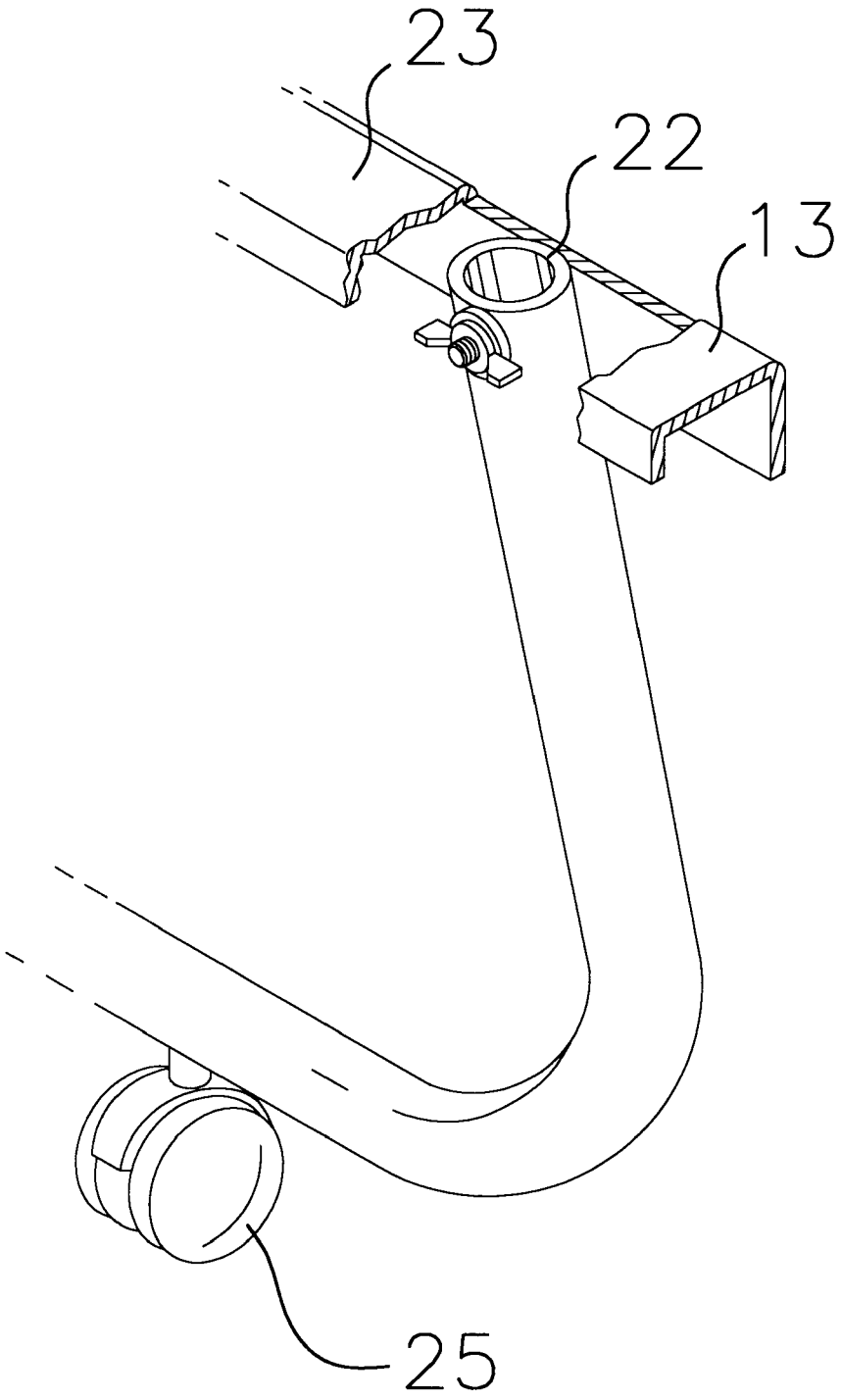
FIG. 4 is a perspective view of a section of the middle support leg showing how the leg connects to the mainframe connection channel making up the mid portion of the mainframe.
Figure 7:
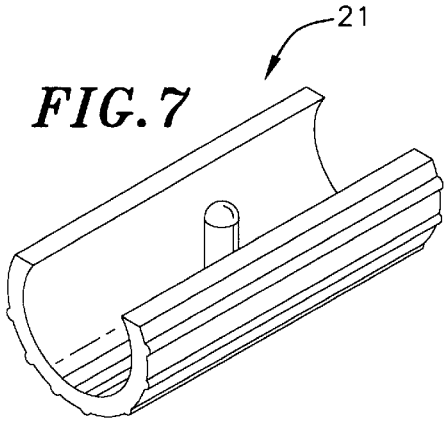
FIG. 7 is a perspective view of a bumper.

Near the left and right edges of the two longitudinal sides 2 of the folding mainframe, are foldaway legs 5 which are preferably halfrectangular in shape. The foldaway legs are also preferably tubular with bumpers 21, preferably made of rubber, snapped and/or clasped on the longitudinal side of the leg facing the floor as shown in FIG. 7. The foldaway legs 5 are hingedly connected to the mainframe to allow the legs to swing open when the bed is in an unfolded position and to swing into and rest with the mattress support element when the bed is in the folded position as shown in FIG. 2. The foldaway legs open to approximately 100 degrees when the bed is in the unfolded position. On each longitudinal side of the mid portion of the mainframe 13 is a detachable middle support leg 6. The detachable middle support leg is attached to the mainframe connection channel bracket 13, also referred to as the mid portion of the mainframe, slightly inward and away from the swinging frames 11 and 12 by connectors such as wing nuts and the like as shown in FIG. 2. After attachment, the top 22 ends of the middle support leg 6 urges on an underside of a top surface 23 of the mainframe connection channel bracket 13, thereby covering the top ends 22 of the middle leg 6 as shown in FIG. 4. For greater stability of the folding bed especially when in the folded position, the detachable legs are preferably arcuately triangular in shape as shown in FIG. 2. To reinforce the detachable legs, a support rod or shaft 24 preferably joins the two legs, the support rod running from the bottom mid portion of one detachable leg to the bottom mid portion of the other detachable leg as shown in FIG. 2, resulting into a one piece assembled leg. To each middle support leg is preferably attached, a caster 25 to enable the folding bed to be rolled around. Two casters on each bottom portion of the middle support leg 6 are preferred for greater stability. The casters are preferably installed with locking means for better control of the movement of the bed. On the two ends of the mid portion 13 of the mainframe along the longitudinal sides, are attached two rods 26, preferably slightly arched, running from one longitudinal side to the other longitudinal side of the mainframe, the rods not urging on the mattress support elements 10 when the bed is in the folded position. This arched feature provides greater comfort to the user because the rods 26 are not in the way of the mattress in lending itself to the movement of the user's body.

On the head lateral side 3 of the mainframe 1 is a first structure element 7 which can be artistically designed to serve as the head frame or head board of the bed. This structure is preferably arched, pressing or urging on a lateral end 27 of the mattress 9 which is laid on top of the mainframe and the mattress support element. On the foot lateral end 4 of the mainframe 1 is a second structure element 8 designed differently from structure element 7 to distinguish the foot portion from the head portion of the bed and serve as the foot frame or foot board. The foot board 8 is preferably less arched than the first structure element 7, shorter in reach, and tucks under the first structure element 7 when the bed is in the folded position as shown in FIG. 2. The second structure element, like the first structure element, press or urges on the mattress to inhibit its movement away from the folding mainframe 1. A fastening means 28 such as Velcro, snap fastener, buckle, clip and the like is preferably attached at the mid portion of the foot lateral side of the mainframe. The fasteners are used to wrap around, tie, connect, or clip the structure elements 7 to the mainframe to further secure the mattress and the structure elements 7 and 8 together when the bed is in the folded position. A second fastening means 29 is also preferably attached to the underside seam 30 of the mattress as shown in FIG. 2. These fasteners wrap around the mainframe to keep the mattress in place. The number of this second fastening means is discretionary.

All open exposed end portions of any part of the folding bed are preferably covered with end caps snapped or pushed into the open tips to prevent metal from scratching the floor or prevent exposure of the interior parts of the folding bed to the outside environment.

While the embodiment of the present invention have been described, it should be understood that various changes, adaptations, and modifications may be made therein without departing from the spirit of the invention and the scope of the claims.

I claim:

1. A folding bed, comprising:

a folding mainframe having two longitudinal and two lateral sides, a head and a foot lateral side, a foldaway leg hingedly connected near a longitudinal edge of the longitudinal sides of the folding mainframe, the two longitudinal sides having three sections, a swinging left frame, a swinging right frame, these swinging frames hingedly attached on each end of a third stationary section at a mid portion of the folding mainframe;

a detachable middle support leg, the detachable middle support leg attaching to each third stationary section of the two longitudinal sides of the mainframe;

a first structure element attached to the head lateral side, the structure element differing in design from a second structure element attached to the foot lateral side;

a mattress;

a mattress support element on the mainframe to support the mattress; and, fastening means to hold or release the first and second structure elements together and confine the mattress in place.

2. The folding bed of claim 1 wherein the third stationary section is a mainframe connection channel bracket.

3. The folding bed of claim 1 wherein the detachable middle support leg is arcuately triangular in shape.

4. The folding bed of claim 1 further comprising a support shaft running from one middle support leg to the other.

5. The folding bed of claim 1 wherein the first structure element is arched and urges on a lateral end of the mattress.

6. The folding bed of claim 1 wherein the second structure element is arched and urges on a lateral end of the mattress.

7. The folding bed of claim 1 wherein the second structure element tucks under the first structure element.

8. The folding bed of claim 1 wherein the mattress support element comprise a plurality of independent rows of flexible metal structure running from one longitudinal side of the mainframe to its opposite corresponding longitudinal side.

9. A folding mainframe comprising two longitudinal sides, two lateral sides, a head and a foot lateral side, a foldaway leg hingedly connected near a longitudinal edge of the longitudinal sides of the folding mainframe, having as improvement, each two longitudinal sides having three sections, a swinging left frame, a swinging right frame, these swinging frames hingedly attached on each end to a third stationary section at a mid portion of the folding mainframe in combination with a detachable middle support leg attaching to each third stationary section of the two longitudinal sides of the mainframe, a first structure element attached to the head lateral side, the structure element differing in design from a second structure element attached to the foot lateral side, a mattress support element on the mainframe supporting a mattress comprising a plurality of independent rows of flexible metal structure running from one longitudinal side of the mainframe to its opposite corresponding longitudinal side, and fastening means to hold or release the first and second structure elements together and confine the mattress in place.

10. The folding bed of claim 9 wherein the independent rows of flexible material has a shape selected from the group consisting of different geometric shapes.

11. The folding bed of claim 10 wherein the geometric shape is a chain of waves.

12. The folding bed of claim 9 wherein the third stationary section is a mainframe connection channel bracket.

13. The folding bed of claim 9 wherein the detachable middle support leg is arcuately triangular in shape.

14. The folding bed of claim 9 further comprising a support shaft running from one middle support leg to the other.

15. The folding bed of claim 9 wherein after attachment of the detachable middle support leg, top ends of the middle support leg urges on an underside of a top surface of the mainframe connection channel bracket, thereby covering the top ends of the middle leg.

16. The folding bed of claim 9 wherein the first structure element is arched and urges on a lateral end of the mattress.

17. The folding bed of claim 9 wherein the second structure element is arched and urges on a lateral end of the mattress.

18. The folding bed of claim 9 wherein the second structure element tucks under the first structure element.

19. The folding bed of claim 9 further comprising on two ends of the mid portion of the mainframe along the longitudinal sides, two arched rods running from one longitudinal side to the other longitudinal side of the mainframe, the rods not urging on the mattress support element when the bed is in the folded position.

* * * * *